US008925685B2

(12) United States Patent
Dufour

(10) Patent No.: US 8,925,685 B2
(45) Date of Patent: Jan. 6, 2015

(54) SHELF APPARATUS FOR USE WITH A LADDER AND SCAFFOLD

(71) Applicant: Donald Dufour, Greene, ME (US)

(72) Inventor: Donald Dufour, Greene, ME (US)

( * ) Notice: Subject to any disclaimer, the term of this patent is extended or adjusted under 35 U.S.C. 154(b) by 9 days.

(21) Appl. No.: 13/768,551

(22) Filed: Feb. 15, 2013

(65) Prior Publication Data

US 2013/0220951 A1 Aug. 29, 2013

Related U.S. Application Data

(60) Provisional application No. 61/600,245, filed on Feb. 17, 2012.

(51) Int. Cl.

| | |
|---|---|
| ***E04G 1/00*** | (2006.01) |
| ***E04G 3/00*** | (2006.01) |
| ***E06C 5/32*** | (2006.01) |
| ***E06C 7/14*** | (2006.01) |
| ***E04G 5/00*** | (2006.01) |

(52) U.S. Cl.
CPC .. *E06C 7/14* (2013.01); *E04G 5/003* (2013.01)
USPC ..... 182/129; 248/210; 211/126.1; 211/70.6

(58) Field of Classification Search
CPC ..... E06C 7/14; E06C 7/16; E06C 1/387; E06C 1/393; E06C 1/06; E06C 7/165; E06C 7/081; E06C 7/143; E06C 1/39; E06C 7/482; E06C 7/48; E04G 5/003; E04G 5/00; A47C 12/00; A47C 7/70; B44D 3/126; B44D 3/14; A47B 13/16; A47F 7/0028; A47F 7/0035; A47F 5/112; A47F 5/114; A47F 5/16
USPC ..... 211/86.01, 13.1, 70.6, 126.1, 90.01, 211/90.02, 187, 134, 135, 150; 248/210, 248/211, 238; 108/42, 152, 25, 26, 149; 182/129, 121, 115, 107; 29/428; D25/68
See application file for complete search history.

(56) References Cited

U.S. PATENT DOCUMENTS

| | | | | | |
|---|---|---|---|---|---|
| 1,216,214 | A | * | 2/1917 | Connell | 182/121 |
| 2,444,096 | A | * | 6/1948 | Faust | 220/570 |
| 2,726,901 | A | * | 12/1955 | Newman et al. | 182/120 |
| 3,331,577 | A | * | 7/1967 | Grunwaldt | 248/238 |
| 3,998,416 | A | * | 12/1976 | Benolkin | 248/210 |
| 4,445,659 | A | * | 5/1984 | LaChance | 248/210 |
| 4,874,147 | A | * | 10/1989 | Ory et al. | 248/210 |
| D307,187 | S | * | 4/1990 | Schaf | D25/68 |
| 5,052,581 | A | * | 10/1991 | Christ et al. | 220/570 |
| 5,358,070 | A | * | 10/1994 | Bartnicki et al. | 182/173 |
| 5,613,574 | A | * | 3/1997 | Melanson | 182/129 |
| 5,673,885 | A | * | 10/1997 | Pham | 248/210 |
| D388,883 | S | * | 1/1998 | Thivierge et al. | D25/68 |

(Continued)

*Primary Examiner* — Jennifer E Novosad
(74) *Attorney, Agent, or Firm* — Berenato & White, LLC

(57) ABSTRACT

A shelf apparatus for use with a ladder or scaffold structure is provided. The shelf apparatus includes a substantially planar shelf structure having a plurality of holes positioned on a first side, wherein at least one of the plurality of holes is formed about a first axis positioned substantially perpendicular to the shelf structure. A cross-member engagement support is positioned on a second side of the shelf structure, the second side of the shelf structure opposite the first side, wherein the cross-member engagement support is formed about a second axis running from a first edge to a second edge of the shelf structure, and wherein the second axis intersects the first axis. A ladder-attachment structure is affixed to the shelf structure.

19 Claims, 7 Drawing Sheets

(56) References Cited

U.S. PATENT DOCUMENTS

| | | | | | |
|---|---|---|---|---|---|
| 5,722,507 | A * | 3/1998 | Kain | 182/129 |
| 5,740,883 | A * | 4/1998 | Trank | 182/129 |
| 5,901,998 | A * | 5/1999 | Gallo, Jr. | 294/143 |
| 5,918,550 | A * | 7/1999 | Weir et al. | 108/42 |
| 5,967,259 | A * | 10/1999 | Williams | 182/129 |
| 6,000,497 | A * | 12/1999 | Kain et al. | 182/129 |
| 6,341,666 | B1 * | 1/2002 | Allen | 182/129 |
| D484,251 | S * | 12/2003 | Pruett et al. | D25/68 |
| 6,691,825 | B2 * | 2/2004 | Haig | 182/107 |
| 6,698,548 | B1 * | 3/2004 | Verrill | 182/129 |
| 7,063,187 | B1 * | 6/2006 | Lavigne | 182/129 |
| 7,077,238 | B2 * | 7/2006 | Butler et al. | 182/129 |
| 7,264,084 | B1 * | 9/2007 | Switzer | 182/129 |
| D627,487 | S * | 11/2010 | Lopez | D25/68 |
| 8,469,148 | B2 * | 6/2013 | Perry | 182/129 |
| 8,490,747 | B2 * | 7/2013 | Winslow et al. | 182/129 |
| 8,528,696 | B2 * | 9/2013 | Astor | 182/129 |
| 8,596,454 | B1 * | 12/2013 | Carlson | 206/373 |
| 2001/0052437 | A1 * | 12/2001 | MacSweeney et al. | 182/129 |
| 2002/0017430 | A1 * | 2/2002 | Rosko | 182/129 |
| 2005/0056486 | A1 * | 3/2005 | Butler et al. | 182/129 |
| 2005/0247838 | A1 * | 11/2005 | Zodnik | 248/238 |
| 2005/0258002 | A1 * | 11/2005 | Sabo | 182/129 |
| 2007/0181761 | A1 * | 8/2007 | Astor | 248/238 |
| 2007/0284192 | A1 * | 12/2007 | Meyers et al. | 182/129 |
| 2009/0032662 | A1 * | 2/2009 | Parrott et al. | 248/238 |
| 2010/0200331 | A1 * | 8/2010 | Hager | 182/107 |
| 2013/0112502 | A1 * | 5/2013 | Oliver | 182/129 |

* cited by examiner

SHELF APPARATUS FOR USE WITH A LADDER AND SCAFFOLD

CROSS REFERENCES TO RELATED APPLICATIONS

This application claims the benefit of U.S. Provisional Patent Application No. 61/600,245 filed on Feb. 17, 2012, in the name of Donald Dufour, entitled "SHELF APPARATUS FOR USE WITH A LADDER AND SCAFFOLD" the disclosure of which is expressly incorporated herein by reference in its entirety.

FIELD OF THE DISCLOSURE

The present disclosure is generally related to a holding device and more particularly is related to a shelf apparatus for use with a ladder and scaffold.

BACKGROUND OF THE DISCLOSURE

Ladders and scaffolding are used for many tasks, including enabling someone to work on an elevated object. Ladders are also frequently utilized to enable a person to paint an area such as the higher portions of a wall or such as a ceiling. During such work, the person performing the work often requires the availability of various tools such as hammers, screwdrivers, pliers, electronic devices, such as screw guns, and even supplies like paint, screws, and fasteners, etc. For example, when a painter is painting an elevated area, it may be desired to hold the supply of paint adjacent the top of the ladder, such as a can or bucket of paint or a pan filled with paint.

The typical stepladder has two front legs which support the step members and two rear legs which lean to support the front legs and thus the step members. The front legs are typically rigidly fastened to a top step, while the rear legs are pivotally attached to that same top step. This permits the stepladder to be folded for storage. Such stepladders generally have a small, pivotally attached ladder shelf which, when the ladder is in use, extends horizontally from the rear legs, generally at a height at or just below the first step down from the top of the ladder. The ladder shelf can be pivoted to lie flat against the rear legs when the ladder is folded for storage. The pivotal attachment often results in the shelf being somewhat unstable. In addition, such shelves are generally small, with only limited surface area for holding tools. Often, also, such shelves consist of two boards fastened to cross-arms and having a gap between them. Further, such a shelf is generally made of light materials and can support only moderate weight. As a result of all this, tools or other items are likely to drop from the shelf, making it necessary for the person on the ladder to get down to retrieve the dropped items.

Similarly, workers will often use scaffolding structures for various phases of construction and building repair and will typically stand on a lower platform of the scaffolding while work is being done on a particular portion of the building, the scaffolding then being movable from place to place to continue construction operations. Typical scaffolds are formed of elongated tubular or angle members which are either bolted or welded together at their ends. Very little attention is typically given by scaffold manufacturers to accessories which will assist a worker in holding weighty objects during completion of the work task at hand.

Thus, a heretofore unaddressed need exists in the industry to address the aforementioned deficiencies and inadequacies.

SUMMARY OF THE DISCLOSURE

Embodiments of the present disclosure provide a system and method for a shelf apparatus. Briefly described, in architecture, one embodiment of the system, among others, can be implemented as follows. The shelf apparatus includes a substantially planar shelf structure having a plurality of holes positioned on a first side, wherein at least one of the plurality of holes is formed about a first axis positioned substantially perpendicular to the shelf structure. A cross-member engagement support is positioned on a second side of the shelf structure, the second side of the shelf structure opposite the first side, wherein the cross-member engagement support formed about a second axis running from a first edge to a second edge of the shelf structure, and wherein the second axis intersects the first axis. A ladder-attachment structure is affixed to the shelf structure. The ladder-attachment structure may include a clip that allows the shelf apparatus to be universally affixed to and used in all step ladder applications.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
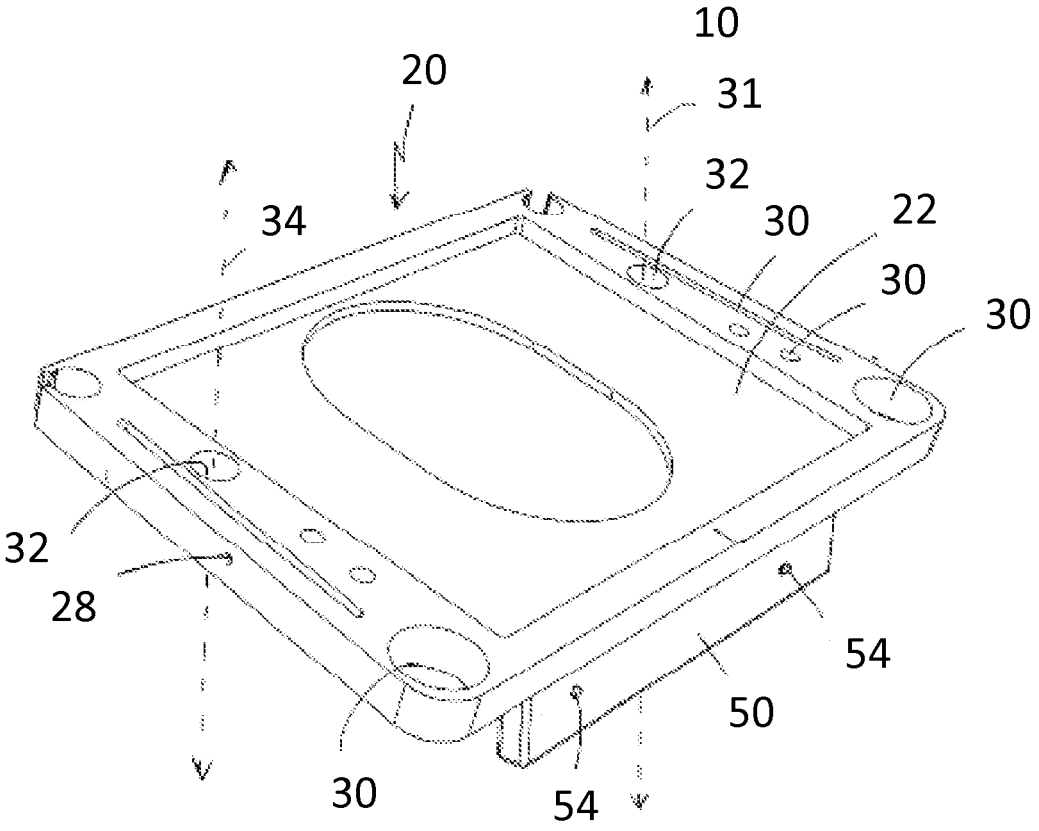
FIG. 1 is a top plan view illustration of a shelf apparatus, in accordance with a first exemplary embodiment of the present disclosure.
Figure 2:
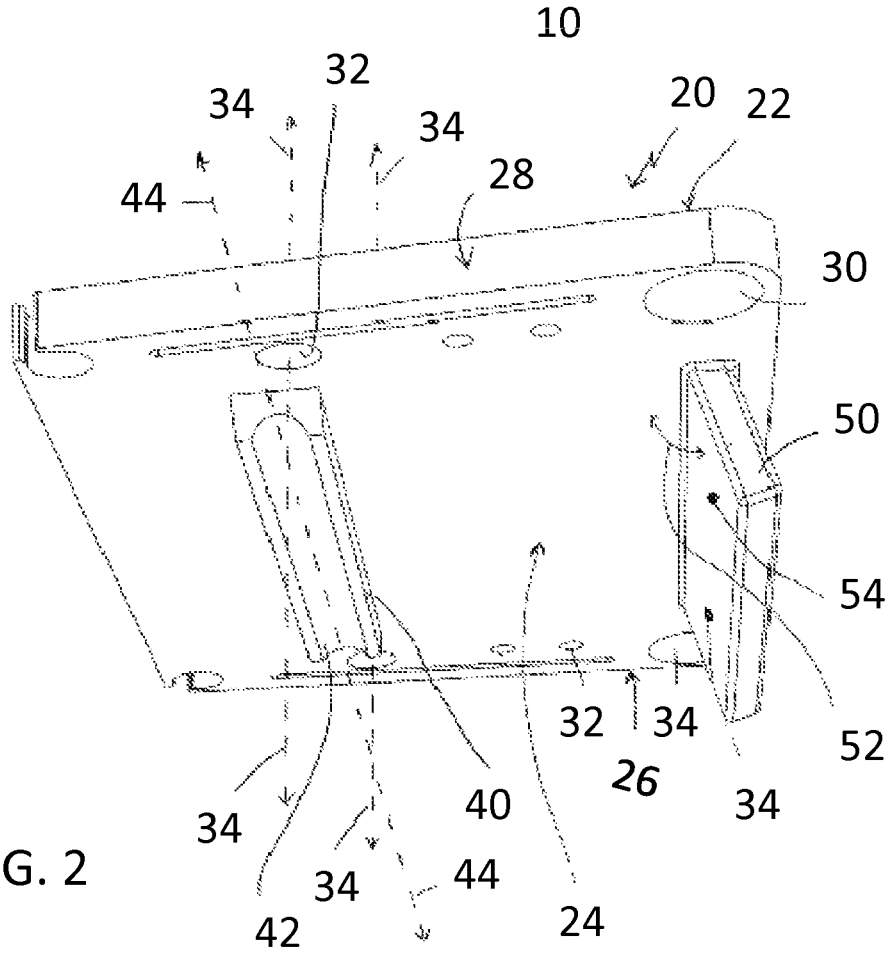
FIG. 2 is a bottom plan view illustration of the shelf apparatus of FIG. 1, in accordance with the first exemplary embodiment of the present disclosure.

FIG. 1 is a top plan view illustration of a shelf apparatus 10, in accordance with a first exemplary embodiment of the present disclosure. FIG. 2 is a bottom plan view illustration of the shelf apparatus 10 of FIG. 1, in accordance with the first exemplary embodiment of the present disclosure. The shelf apparatus 10, may be referred to herein as "apparatus 10. With reference to both FIGS. 1-2, the shelf apparatus 10 includes a substantially planar shelf structure 20 having a plurality of holes 30 positioned on a first side 22, wherein at least one of the plurality of holes 32 is formed about a first axis 34 positioned substantially perpendicular to the shelf structure 20. A cross-member engagement support 40 is positioned on a second side 24 of the shelf structure 20. The second side 24 of the shelf structure 20 is opposite the first side 22, wherein the cross-member engagement support 40 is formed about a second axis 44 running from a first edge 26 to a second edge 28 of the shelf structure 20. The second axis 44 intersects the first axis 34. A ladder-attachment structure 50 is also affixed to the shelf structure 20.

The apparatus 10 may be used as a shelf, supporting structure, or holding structure, for holding or supporting a variety of tools, devices, and other items. Preferably, the apparatus 10 may be used with a ladder and/or a scaffold system, to hold and support building supplies and tools for workers that require the use of the ladder or scaffold system. The apparatus 10 may provide a reliable and stable platform for small items, such as nuts and bolts, to holding larger items such as paint cans and power equipment, and any other item in between. The apparatus 10 may be sized to be placed on a ladder or scaffold system but not interfere with a worker's space, such that the worker might accidently knock over a can of paint off the apparatus.

A substantial part of the apparatus 10 is the substantially planar shelf structure 20, which generally forms the body and working surface of the apparatus 10. The shelf structure 20 is substantially planar in that it provides a rigid, substantially horizontal platform for tools and items to be stored. Of course, as is shown in FIG. 1, the shelf structure 20 may have a variety of bossing, texturing, indentations, or other structures formed within the first side 22. These structures may be used to provide an interior work space within the shelf structure 20, as defined from an edging of the shelf structure 20. The shelf structure 20 may include any number of holes 30 that are formed at a variety of locations. The holes 30 may be sized with any shape or radius, including circular holes, elongated slots, and holes with broken sides. Some of the holes 30 may include partial openings in the circumference of the hole, thereby allowing the hole to be used for retaining an extension cord or similar structure at the elevated surface where the apparatus 10 is being used.

At least one hole 32 of the plurality of holes 30 is formed about a first axis 34. The first axis 34 may run through a substantially central point of the at least one hole 32. The first axis 34 may intersect substantially perpendicularly with the plane of the shelf structure 20. In FIGS. 1-2, there are two holes 32 shown with a first axis 34, each of which is aligned with the cross-member engagement support 40 (FIG. 2). The cross-member engagement support 40 may be used to engage with a cross-member of a scaffold system to retain the apparatus 20 for use. The cross-member engagement support 40 may be positioned to run from a first edge 26 to a second edge 28 of the shelf structure 20, and may have any surface for engagement with the cross-member, such as an arced or curved interior surface 42, as is shown in FIG. 2. A second axis 44 may run along the length of the cross-member engagement support 40, generally at a central point of the interior surface 42. As is discussed relative to FIGS. 4-5, the combination of the hole 32 having the first axis 34 and the cross-member engagement support 40 may be used to retain the apparatus 10 in a working position on a scaffold system.

Figure 3:
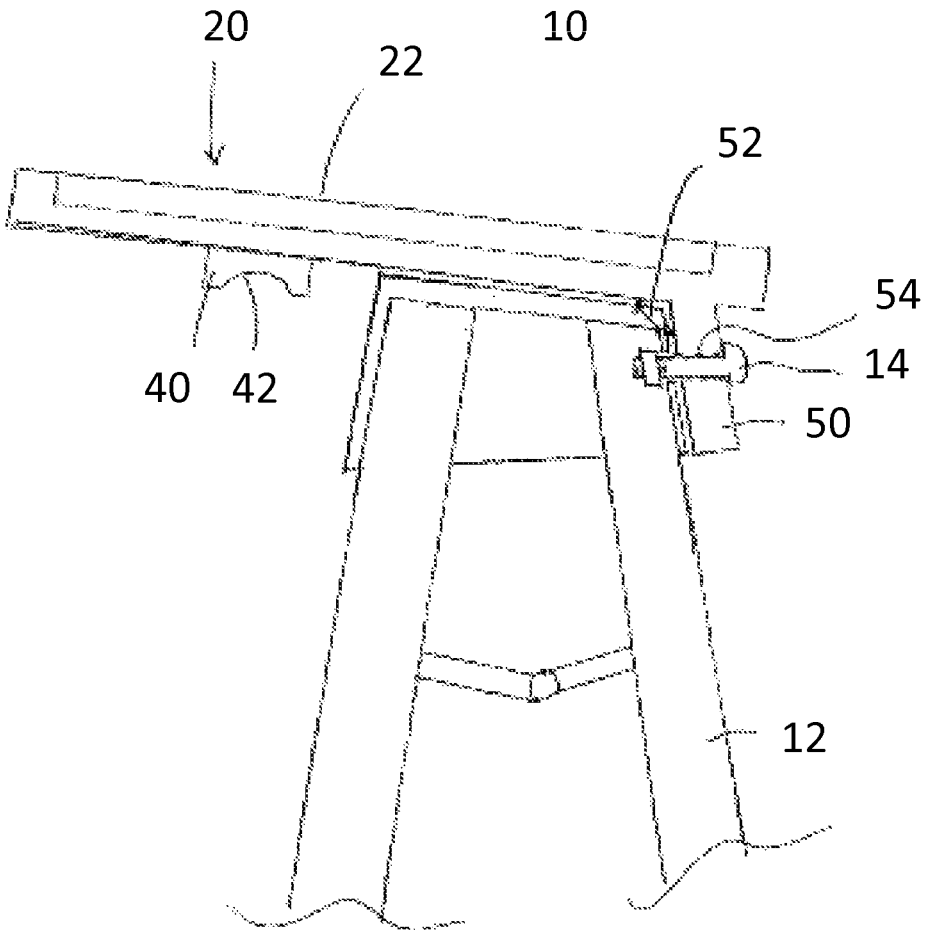
FIG. 3 is aside cross-sectional view illustration of the shelf apparatus of FIG. 1 positioned in use with a ladder, in accordance with the first exemplar embodiment of the present disclosure.

The ladder-attachment structure 50 is shown best in FIG. 2, wherein the ladder-attachment structure 50 runs between the first edge 26 and the second edge 28 of the shelf structure 20. The ladder-attachment structure 50 may have a variety of sizes and may be connected to the shelf structure 20 at an angle 52. In FIG. 2, the angle 52 of the ladder-attachment structure 50 is shown to be approximately 100° however any angle 52 may be used with the ladder-attachment structure 50. The angle 52 may be provided to allow the first surface 22 of the shelf structure 20 to be substantially level with the ground, when the apparatus 10 is affixed to a ladder (FIG. 3). To affix the apparatus 10 to a ladder, the ladder-attachment structure 50 may include a plurality of fastening structures 54, such as a hole or aperture, in which a fastener can be inserted. The fastener may be connected to the ladder to securely hold the apparatus 10 in place.

FIG. 3 is a side cross-sectional view illustration of the shelf apparatus 10 of FIG. 1 positioned in use with a ladder 12, in accordance with the first exemplary embodiment of the present disclosure. The ladder-attachment structure 50 may engage with the ladder 12 via a fastener 14 positioned within the fastening structure 54, as is shown in FIG. 3. The fastener 14 may traverse through the ladder-attachment structure 50 and into the top portion of the ladder 12, where a bolt, wignut, or similar device may retain the fastener 14 in place. When the ladder-attachment structure 50 is in this position, the shelf structure 20 may be positioned above the op of the ladder 12, thereby allowing the first side 22 of the shelf structure 20 to be used as platform or work surface. As can be seen in FIG. 3, the angle 52 between the ladder-attachment structure 50 and the shelf structure 20 may allow the shelf structure 20 to be positioned horizontal or level with a ground surface, with the top of the ladder 12 positioned between the cross-member engagement support 40.

Figure 4:
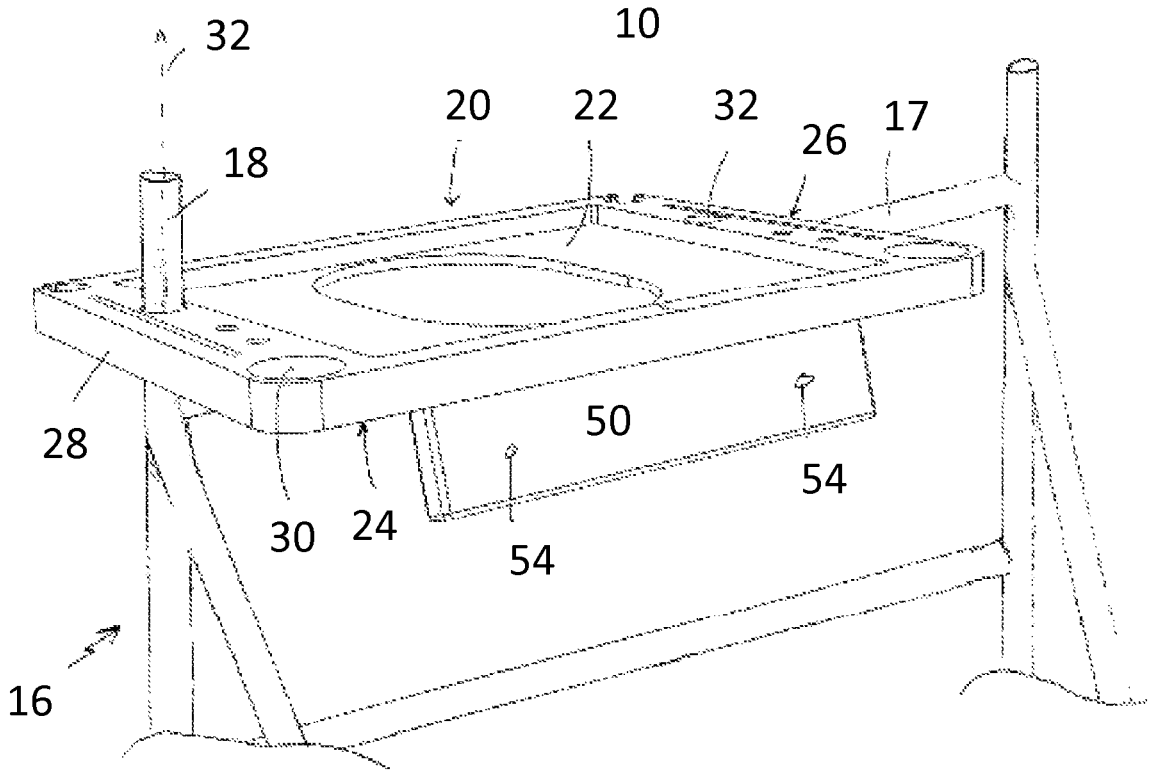
FIG. 4 is top plan view illustration of the shelf apparatus of FIG. 1 positioned in use with a scaffold system, in accordance with the first exemplary embodiment of the present disclosure.
Figure 5:
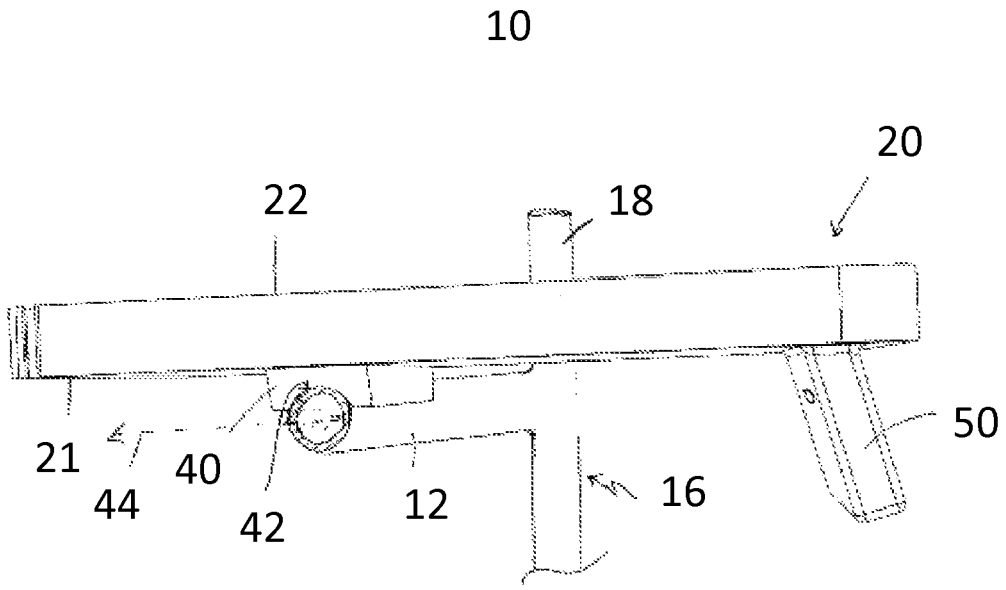
FIG. 5 is side cross-sectional view illustration of the shelf apparatus of FIG. 1 positioned in use with a scaffold system, in accordance with the first exemplary embodiment of the present disclosure.

FIG. 4 is top plan view illustration of the shelf apparatus 10 of FIG. 1 positioned in use with a scaffold system 16, in accordance with the first exemplary embodiment of the present disclosure. FIG. 5 is side cross-sectional view illustration of the shelf apparatus 10 of FIG. 1 positioned in use with a scaffold system 16, in accordance with the first exemplary embodiment of the present disclosure. As is shown in FIGS. 4-5, the apparatus 10 may be used with a scaffold 16 or system of scaffold structures, in addition to the apparatus 10 being used with a ladder, as is depicted in FIG. 3. When the apparatus 10 is used with a scaffold system 16, a vertical member 18 of the scaffold system 16 may be positioned through the hole 32 having the first axis 34. The hole 32 may be sized to receive the vertical member 18 with a specific tolerance, thereby providing a tight fit between the structures. Any number of holes 32 may be included within the shelf structure 20, such as one on the first edge 26 and another on the second edge 28.

The apparatus 10 may be lowered onto the vertical member 18 such that the cross-member engagement support 40 (FIG. 5) is positioned to engage the horizontal member 17 of the scaffold system 16. In this manner, both the connection between the vertical member 18 through the hole 32, and the cross-member engagement support 40 on the horizontal member 17 may support the apparatus 10 sufficiently. As is shown in FIG. 5, the horizontal member 17 of the scaffold system 16 may engage with the interior surface 42 of the cross-member engagement support 40, such that the second axis 44 of the cross-member engagement support 40 may run linearly from the first edge 26 (FIG. 4) to the second edge (FIG. 4). The hole 32 may be aligned on the shelf structure 20 with the cross-member engagement support 40 such that the first axis 34 intersects the second axis 44. This positioning allows the apparatus 10 to be used with standard scaffold systems 16, most of which have a vertical member 18 connected to a horizontal member 17. When the apparatus 10 is used with a scaffold system 16, the positioning of the ladder-attachment structure 50 may be such that it does not interfere with the components of the scaffold system 16

Figure 6:
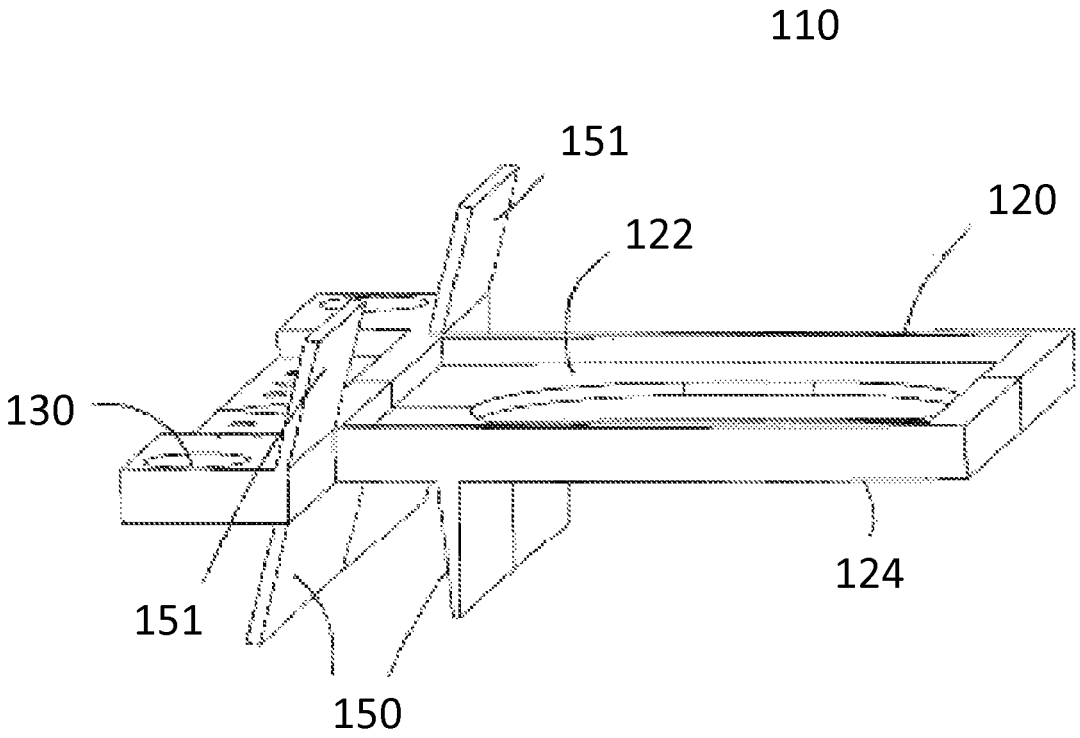
FIG. 6 is a plan view illustration of a shelf apparatus, in accordance with a second exemplary embodiment of the present disclosure.
Figure 7:
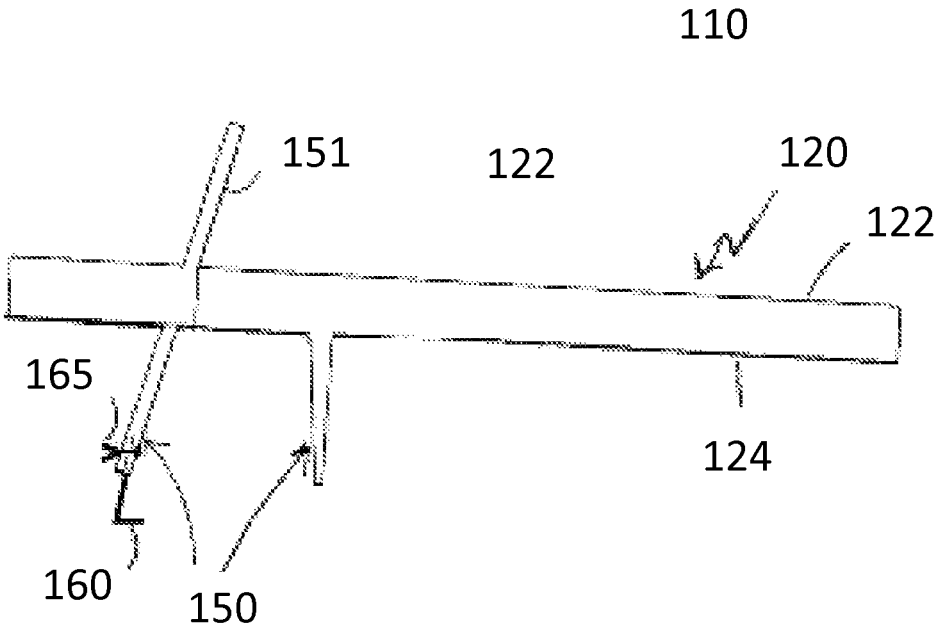
FIG. 7 is a side view illustration of the shelf apparatus of FIG. 6, in accordance with the second exemplary embodiment of the present disclosure, and is shown including a clip that allows the shelf apparatus to be universally affixed to and used in all step ladder applications.

FIG. 6 is a plan view illustration of a shelf apparatus 110, in accordance with a second exemplary embodiment of the present disclosure, FIG. 7 is a side view illustration of the shelf apparatus 110 of FIG. 6, in accordance with the second exemplary embodiment of the present disclosure. The shelf apparatus 110, which may be referred to herein as "apparatus 110" may include any of the features, designs, or functions of any of the embodiments disclosed herein. With reference to FIGS. 6-7, the shelf apparatus 110 includes a substantially planar shelf structure 120 having a plurality of holes 130 positioned on a first side 122.

A first ladder-attachment structure 150 is affixed to the shelf structure 120 on the second side 124, while a second ladder-attachment structure 151 is positioned on a first side 122, which is opposite to the second side 124. Both of the first and second ladder-attachment structures 150, 151 may be used to retain the apparatus 110 on a ladder. Specifically, the first ladder-attachment structure 150 may be used to engage with a rung of the ladder, such that the rung fits between the first ladder-attachment structure 150. At the same time, the second ladder-attachment structure 151 may rest against the legs of the ladder to hold the apparatus 110 in place on the ladder. In this position, the apparatus 110 may be secured stably such that someone using the apparatus 110 can place tools and other items on the shelf structure 120, and within the holes 130.

Referring to FIG. 7, the side view illustration of the shelf apparatus 110 shows a clip 160 that allows the shelf apparatus 110 to be universally affixed to and used in all step ladder applications. The clip 160 is removeably attachable to a first ladder-attachment structure 150 using a bolt and wing-nut 165 or other type fastener. Multiple fasteners could also be used in some embodiments. The clip 160 is slideably movable on the first ladder-attachment structure 150, and in some embodiments may fit into a slot fashioned into the first ladder-attachment structure 150.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A shelf apparatus comprising:

a substantially planar shelf structure having a plurality of holes positioned on a first side, wherein at least one of the plurality of holes is formed about a first axis positioned substantially perpendicular to the shelf structure;

a cross-member engagement support positioned on a second side of the shelf structure, the second side of the shelf structure opposite the first side, wherein the cross-member engagement support is formed about a second axis running from a first edge to a second edge of the shelf structure, wherein the second axis intersects the first axis and the second axis is oriented substantially parallel to a plane defined by a plurality of rungs on a ladder when the shelf structure is mounted on the ladder; and an attachment structure affixed to the shelf structure for removably mounting said shelf structure on said ladder.

2. The shelf apparatus of claim 1, wherein said attachment structure is configured for use with at least one of a ladder or a scaffold system, and said attachment structure is aligned along a third axis substantially parallel to said second axis.

3. The shelf apparatus of claim 2, wherein said attachment structure is adapted to engage the top platform that hinges the apex of a triangulated free-standing ladder.

4. The shelf apparatus of claim 3, wherein said attachment structure is configured to allow the first side of the shelf structure to be substantially level with the ground, when said apparatus is affixed to said ladder.

5. The shelf apparatus of claim 4, wherein said attachment structure includes a plurality of fastening structures, including at least a hole or aperture in which a fastener can be inserted.

6. The shelf apparatus of claim 3, wherein said attachment structure includes a moveably mountable clip adapted to attach said shelf apparatus to said top platform on said ladder.

7. The shelf apparatus of claim 2 further comprising:

a second attachment structure positioned on said first side, said second attachment structure being positioned opposite said second side and aligned along a fourth axis substantially parallel to said second axis;

wherein said second attachment structure is adapted to engage against legs of said ladder to hold said apparatus in place on said ladder.

8. The shelf apparatus of claim 7, wherein said second attachment structure is connected to said shelf structure at an angle.

9. The shelf apparatus of claim 8, wherein said angle of the attachment structure is configured to be an angle to allow the first side of the shelf structure to be substantially level with the ground, when said apparatus is affixed to said ladder.

10. The shelf apparatus of claim 9, wherein said second attachment structure includes a plurality of fastening structures, including at least one of a hole or aperture in which a fastener can be inserted and a slideably movable connector clip.

11. The shelf apparatus of claim 1, wherein said cross-member engagement support is adapted to engage a horizontal cross-member of a scaffold system, when a vertical member of said scaffold system is positioned through the at least one hole formed about said first axis, where said hole is sized to receive said vertical member.

12. The shelf apparatus of claim 11, wherein said at least one hole among said plurality of holes is positioned on at least one of said first edge and said second edge.

13. The shelf apparatus of claim 12, wherein at least one hole among said plurality of holes is positioned on at least one of a third edge and a forth edge.

14. The shelf apparatus of claim 1, wherein said plurality of holes are positioned substantially around the perimeter edges of said shelf structure and at least two holes are aligned with said cross-member engagement support along said second axis.

15. A shelf apparatus comprising:

a substantially planar shelf structure having a plurality of holes adapted to engage at least tools and positioned on a first side proximate to edges of the shelf structure, wherein a first hole of the plurality of holes is formed about a first axis and a second hole of the plurality of holes is formed about a second axis, and both the first axis and the second axis are positioned substantially perpendicular to the shelf structure;

a cross-member engagement support positioned on a second side of the shelf structure, the second side of the shelf structure opposite the first side, wherein the cross-member engagement support is formed about a third axis running from a first edge to a second edge of the shelf structure, wherein the third axis intersects the first axis and the second axis, and the third axis is oriented substantially parallel to a plane defined by a plurality of rungs on a ladder when the shelf structure is mounted on the ladder; and an attachment structure affixed to the shelf structure for removably mounting said shelf structure, wherein the attachment structure is adapted for use with at least one of a ladder or a scaffold-system, and said attachment structure is aligned along a fourth axis substantially parallel to said third axis.

16. The shelf apparatus of claim 15, further comprising at least one moveably mountable clip adapted to engage a lower edge of a top platform hinging the apex of a triangulated free-standing ladder.

17. The shelf apparatus of claim 15, wherein the first hole and the second hole are each adapted to engage a vertical member of a scaffold-system.

18. The shelf apparatus of claim 15, wherein said attachment structure includes a plurality of fastening structures, including at least a hole or aperture in which a fastener can be inserted.

19. The shelf apparatus of claim 15, wherein said attachment structure is adapted to engage said ladder on a front side mountable by a user and position said shelf structure extending substantially toward the backside of said ladder.

* * * * *